US005294263A

United States Patent [19]

Riso

[11] Patent Number: 5,294,263

[45] Date of Patent: Mar. 15, 1994

[54] NON-HAZARDOUS BLENDS OF PROPIONATES

[75] Inventor: Anthony Riso, Piermont, N.Y.

[73] Assignee: Rossi Technology Corporation, Orangeburg, N.Y.

[21] Appl. No.: 933,246

[22] Filed: Aug. 21, 1992

[51] Int. Cl.[5] ..... C23G 5/00

[52] U.S. Cl. ..... 134/40; 252/170; 252/364; 106/311

[58] Field of Search ..... 106/311; 134/40, 38, 134/42; 252/170, 364

[56] References Cited

U.S. PATENT DOCUMENTS

| | | | |
|---|---|---|---|
| 4,808,440 | 2/1989 | Tasset | 427/372.2 |
| 4,965,167 | 10/1990 | Salamy | 430/191 |
| 5,128,230 | 7/1992 | Templeton et al. | 430/191 |
| 5,147,455 | 9/1992 | Watanabe et al. | 106/2 |

FOREIGN PATENT DOCUMENTS

| | | | |
|---|---|---|---|
| 3-37299 | 2/1991 | Japan | C11D 7/26 |
| 3-41170 | 2/1991 | Japan | C09D 9/00 |

*Primary Examiner*—Linda Skaling
*Assistant Examiner*—Margaret Einsmann

[57] ABSTRACT

A cleaning solvent made up of blends of propionate esters. Propionate esters selected from the group methyl propionate, butyl propionate, propyl propionate and higher homologues, are blended with esters selected from the group methyl hydroxypropionate, ethyl hydroxypropionate and higher homologues. Blends of these esters produces cleaning effectiveness and low toxicity.

The mixtures are particularly useful in electronic parts cleaning and defluxing, and for degreasing. The blending of the propionate solvents produces a selective range of evaporation rates and Flash Points.

3 Claims, No Drawings

NON-HAZARDOUS BLENDS OF PROPIONATES

BACKGROUND OF THE INVENTION

This invention relates to the composition of non-hazardous and non-toxic solvent systems. The objective of this invention is to provide alternatives to those solvents or solvent compositions that are either labeled hazardous by OSHA (Occupational Safety and Health Act), or have an undesirable Toxicology a defined by TLV (Threshold Limit Value ). Those solvents with TLV of less than 1000 are to be considered undesirable and in need to be replaced.

Further objectives of this invention is to offer replacements for those solvents identified by the International agreements of the "Montreal Protocol". An urgent list of Ozone depleting solvents has been drawn up with the highest Ozone depleting solvents to be phased out by 1995. These chemicals include the Halogenated solvents: Chloro-Fluorinated Carbons (CFC's), Tri-Chloroethane and Carbontetrachloride. A balance of other chemicals and solvents that have less severe Ozone depleting ratings are to be phased out by the year 2000. Many of the Halogenated solvents are used in industrial applications because of their good solvency, fast evaporation and non-flammable rating. The objective is to offer a balance of properties with a new system of solvents that is safe for the environment and safe for the workers.

SUMMARY OF THE INVENTION

This invention is comprised of the chemical group of organic esters. More specifically, the esters herein described are the propionates of n-butyl propionate and ethyl hydroxy propionate. The methyl, ethyl, proply or higher propionate or hydroxy propionates may also be used. The solvent systems of this invention have application as industrial cleaning solvents. Of the broader range of usage, these solvent systems can be used as "Safe Solvent" degreasers in removing oils and waxes from metal parts and the like. It has further application as ink removers such as printing ink clean-up from print rollers, machinery and the like. In specialized areas, these solvent blends are particularly useful in electronic applications. More specifically, the invention was developed for the cleaning of screens and substrates in the thick film process. The thick film process utilizes the technique of depositing paste materials onto ceramic substrates by screening through wire screens. The accuracy needed in this process enhances the need for frequent cleaning of the wire screens. Misprints onto substrates also require frequent washing with solvent. The solvent blends of this invention have been shown to be effective removers of the pastes used in the thick film process. The drying characteristics are also ideal for this application. The rapid drying at the work station does not allow time for the solvent to penetrate the screens. Drying that is to slow would retain solvent in the screen wires and slow-up the manufacturing process.

In particular, the invention addresses the requirements of removing thick film pastes, such as cermet inks used in the hybrid industry, from screens without degrading the screen emulsions, which are photosensitized polymers. The balance of properties permits a drying rate that is consistent with the screen cleaning requirements.

A further objective was to modify the odor strength of solvents in the workplace. The addition of ethyl hydroxy propionate propionate greatly reduces the objectionable odor of n-butyl propionate. n-butyl propionate has the greater solvent power and enhances the potency of the propionate mixture. It also produces the advantage of reducing the cost of the system.

Another objective of the invention is to balance evaporation and be able to provide a "Non-Flammable" rating per DOT (Department of Transportation) standards of above 100 degrees Fahrenheit flash point.

DETAILS OF THE INVENTION

Example I

A blend of n-butyl propionate with ethyl hydroxy propionate was made of the following mixture:

| | Parts by weight |
|---|---|
| n-butyl propionate | 20 |
| ethyl hydroxy propionate | 80 |

It was found that the addition of n-butyl propionate to the ethyl hydroxy propionate resulted in a synergistic mixture with enhanced cleaning power over the ethyl hydroxy propionate alone, while the more potent odor of the n-butyl propionate was greatly mitigated by the content of the milder ethyl hydroxy propionate. The admixture of Example I. has a Flash Point above 100 degrees Fahrenheit and is Non-Flammable per D.O.T. standards.

Example II

A blend of higher content of n-ButylPropionate with lower content of EthylHydroxyPropionate was made at the following ratio:

| | Parts by weight |
|---|---|
| n-ButylPropionate | 80 |
| EthylHydroxyPropionate | 20 |

The higher level of n-ButylPropionate had the effect of speeding up the evaporation rate. Another result of this admixture was a greater solvent potency was demonstrated when compared to the potency for the mixture in Example I. A comparison of the odor of the two examples indicated a significantly stronger odor for the blend of Example II. vs. that for Example I. These blends demonstrate the range and balance of properties obtainable within this technology. The evaporation rate of Example II was noted to be faster than that for Example I. Both admixtures maintain the desirable property of having a Non-Flammable Rating per D.O.T. with Flash Points above 100 degrees Fahrenheit.

What is claimed:

1. A method of cleaning electronic equipment and parts, flux removal, and degreasing surfaces by using a solvent blend consisting of a mixture of 20 to 80 parts by weight of one propionate selected from the group consisting of methyl propionate, ethyl propionate, propyl propionate, butyl propionate and 20 to 80 parts by weight of one hydroxy propionate selected from the group consisting of methyl hydroxy propionate, ethyl hydroxy propionate.

2. A method as in claim 1 wherein the solvent blend consists essentially of 20 to 80 parts by wight of butyl propionate and 20 to 80 parts by wight of ethyl hydroxypropionate.

3. A unique solvent blend to replace hazardous chemicals and solvents in commercial and industrial applications for degreasing, ink removal and paste cleaning for thick film processes in electrical and electronic operations and related industries, consisting of 20 to 80 parts by weight of butyl propionate and 20 to 80 parts by wight of ethyl hydroxypropionate.

* * * * *